United States Patent [19]

Münz

[11] Patent Number: 4,545,293

[45] Date of Patent: Oct. 8, 1985

[54] MULTIPLE-CASING CHIMNEY

[75] Inventor: Werner Münz, Neufahrn, Fed. Rep. of Germany

[73] Assignee: Schiedel GmbH & Co., Munich, Fed. Rep. of Germany

[21] Appl. No.: 360,775

[22] Filed: Mar. 22, 1982

[30] Foreign Application Priority Data

Mar. 30, 1981 [AT] Austria ..... 1485/81

[51] Int. Cl.[4] ..... E04F 17/02

[52] U.S. Cl. ..... 98/58; 110/184

[58] Field of Search ..... 98/58, 60; 110/184; 126/307 R

[56] References Cited

U.S. PATENT DOCUMENTS

| | | | |
|---|---|---|---|
| 1,615,909 | 2/1927 | Nance | 98/58 |
| 4,216,709 | 8/1980 | Buttenbruch | 98/58 |
| 4,381,717 | 5/1983 | Krautz | 98/58 |

FOREIGN PATENT DOCUMENTS

| | | | |
|---|---|---|---|
| 329819 | 5/1976 | Austria . | |
| 168529 | 5/1906 | Fed. Rep. of Germany | 98/58 |
| 838499 | 5/1952 | Fed. Rep. of Germany . | |
| 857865 | 1/1953 | Fed. Rep. of Germany | 98/58 |
| 1694129 | 2/1955 | Fed. Rep. of Germany . | |
| 1196313 | 7/1965 | Fed. Rep. of Germany | 110/184 |
| 1964899 | 7/1967 | Fed. Rep. of Germany . | |
| 61859 | 5/1968 | Fed. Rep. of Germany . | |
| 2317972 | 7/1975 | Fed. Rep. of Germany . | |
| 2521692 | 11/1976 | Fed. Rep. of Germany . | |
| 2745362 | 4/1978 | Fed. Rep. of Germany | 98/58 |
| 2618364 | 6/1978 | Fed. Rep. of Germany . | |
| 456113 | 7/1968 | Switzerland . | |

*Primary Examiner*—Harold Joyce

*Attorney, Agent, or Firm*—Brumbaugh, Graves, Donohue & Raymond

[57] ABSTRACT

A multiple-casing chimney with at least one smoke-carrying inner tube, one heat insulating layer surrounding the inner tube, and one jacket supporting the latter's outside. To prevent moisture saturation or tarring, the invention provides that flow paths for a venting gas supplied from the outside and discharged to the outside be provided within the base material of at least one casing (2, 4) surrounded by the jacket (6) and/or on at least one boundary between adjacent casings (2, 4, 6) between boundary surfaces formed by their respective base materials and be distributed over the circumference.

18 Claims, 25 Drawing Figures

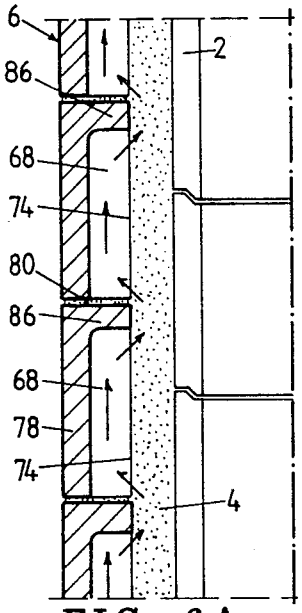
FIG. 6A
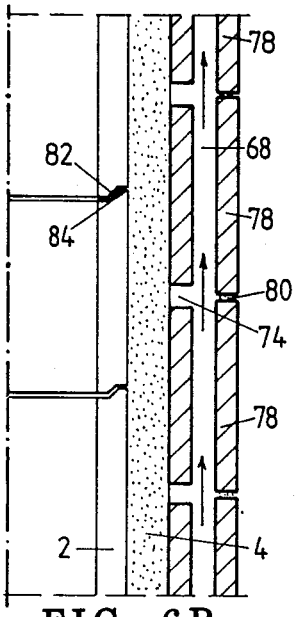
FIG. 6B
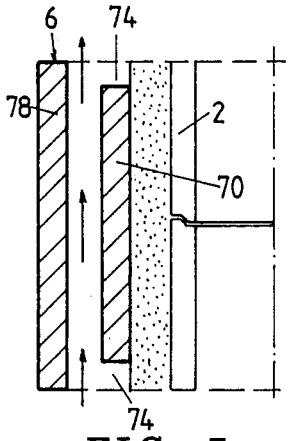
FIG. 7
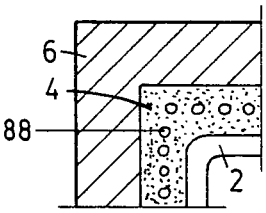
FIG. 10B
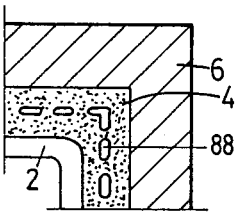
FIG. 10A
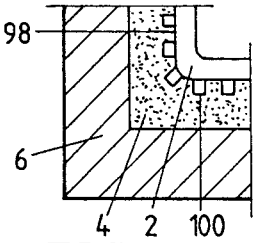
FIG. 10C
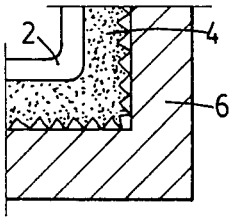
FIG. 10D
FIG. 11
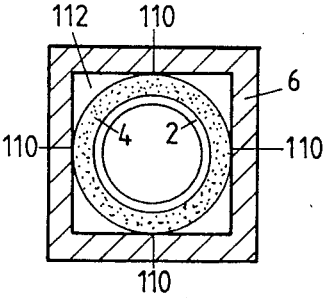
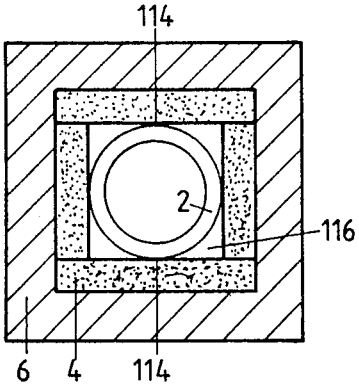
FIG. 12

MULTIPLE-CASING CHIMNEY

BACKGROUND OF THE INVENTION

The invention relates to a multiple-casing chimney of the kind described in claim 1. Such multiple-casing chimneys, or corresponding finished chimney parts, which are to be included in the inventions, are already known from DE-PS No. 19 22 389, for instance.

Due to different physical properties of the individual casings of the chimneys or of the finished parts of which they are constructed, dew points may be fallen below within the chimney which may result in soaking and tarring phenomena associated with a reduction of the heat insulating effect. These disadvantageous phenomena are further intensified by the aggressive smoke components carried along by the steam, particularly $SO_2$ and $SO_3$ and various hydrocarbons. Upon condensation, sulfurous or sulfuric acid may be precipitated, for example.

In the chimney type described, such effects are counteracted by a vapor barrier which is to prevent that moisture and aggressive components carried along get outside of the vapor barrier radially, instead being kept inside the radially inner core area of the chimney where temperatures do not yet fall below the dew point. But the measures required for this are rather costly as far as material and construction costs are concerned, and they are also susceptible to aging when many insulating materials are used.

It is an object of the invention to indicate an alternative solution to master the soaking or tarring phenomena mentioned, which solution is realizable with little technical expense and is less susceptible to ageing.

SUMMARY OF THE INVENTION

A possibility is created within the scope of the invention to reduce accumulating moisture and aggressive components carried along dynamically to a degree practically unharmful in the areas endangered by temperatures dropping below the dew point in that developing moisture in gaseous or liquid state, including its aggressive components, is removed by a venting gas flow independent of the smoke, but conducted through the chimney proper. In particularly simple manner, air may serve as venting gas. Constructionwise, the construction of a special casing is no longer required; in fact, special components, except for those used anyway as base material for the construction of the chimney, are generally dispensable. All that is necessary to create the flow path is to impart a certain shape to the casing or casings involved or, in a borderline case, to utilize an already existing shape of these chimney elements to connect an inlet and outlet of a venting current in novel manner.

The chimney according to the invention offers the possibility of being able, by appropriately designing the flow paths and distributing them within the chimney on the one hand and by dimensioning the inlet and outlet openings of the venting gas on the other, and finally by imposing certain venting gas parameters such as pressure, temperature and possibly also physical and chemical composition, to adapt to very different chimney operating conditions. This even makes it possible to master operating conditions in which the dew point is fallen below inside the inner chimney tube already.

According to one embodiment of the present inventon, the radially innermost casing, the inner tube, may be the carrier of venting gas flow paths. This offers the advantage of being able to combat moisture already at the source of its effect in the chimney. The venting gas may be fed into the inner tube either at its face such as through an upright base or through at least one lateral tap. The analogous applied to the outlet, if necessary in specially designed chimney tops.

It is also possible to conduct the flow path between the inner tube and the heat insulation layer and design the ducts on the outside surface of the inner tube for this purpose. The projections and depressions may be of various geometric shapes, defined by straight lines or rounded off more or less, resulting, for instance, in a peripheral corrugation, alternating webs or grooves, or differently shaped fins. Corresponding designs are possible also on the radially inner and on the radially outer heat insulation layer surface and on the radially outer jacket surface. Thought can be given to providing such peripheral profilings to the two mutually facing boundary surfaces of adjacent layers also. It should suffice in most cases to provide such profilings on one layer only, thereby reducing the forming costs further. It is not absolutely necessary, even not always desirable, to separate the various flow paths distributed over the circumference of the chimney from each other. Much rather, they may very well be short-circuited more or less in circumferential direction, such as due to a radial clearance extant between adjacent casings. If necessary and desirable, such profilings may even be done without completely, provided a sufficiently great radial clearance exists between adjacent layers.

In the case of the heat insulation layer, the projections and depressions at the circumference may be formed particularly simple by slits opened up in curved, slotted heat insulation panels shaped, for instance, as shown in German Provisional Patent No. 21 18 046.

The flow paths may also run within the heat insulation layer from the bottom to the top. Besides a known possibility to provide the heat insulation layer with inner ducts for this purpose, the porosity of the heat insulation layer itself may be utilized as inside diameters of the flow paths in particularly advantageous manner also.

Rising flow paths within the jacket can also be co-utilized for the invention. While it is known (DE-OS No. 18 16 975) to use vertical shafts in the jacket of jacket bricks for the construction of multi-casing chimneys of the kind described at the outset from finished chimney parts as venting channels, cable ducts and the like, such secondary shafts for venting purposes have so far served only as air connections for restrooms, boiler rooms or the like, but not for the ventilation of the chimney interior encased by the chimney jacket. Apart from the fact that such secondary shafts do not extend over the entire perimeter of the chimney. Due to their arrangement and wall design they have no practically utilizable function for the removal of moisture either that may have penetrated the chimney type described with the smoke. Rather, to accomplish this it is necessary for the flow paths in the jacket to be adequately coupled to the chimney area located radially inward, at least as far as diffusion is concerned. This is met, by way of example, by jacket wall areas allowing vapor diffusion and, more strongly yet, when there are open breakthroughs radially inward.

Particularly endangered by moisture loading is the heat insulation layer, if only because of the reduction of its heat insulation effect. But the invention can permit that moisture enters the heat insulation layer, even passes through it radially, if the moisture is constantly removed inside the jacket so that the moisture cannot accumulate in the heat insulation layer beyond a tolerable degree.

Venting a chimney heat insulation layer is known per se (U.S. Pat. No. 2,446,729) for a two-casing chimney of a different kind in which venting channels go through a jacket which serves as heat insulator at the same time.

Productionwise, the simplest way to make the breakthroughs is in the form of vertical slits. The best coupling to the chimney area located radially inward is obtained by using relatively wide slots. But they may impair the support of the heat insulation layer so that narrower shapes are preferable, especially when heat insulation layers not very stable in themselves are involved. When required, the vertical slots can be made part of the flow path, but they may also be of limited height only, such as being coordinated with the respective finished parts, thereby gaining greater circumferential stability in the jacket, for instance. If the load-carrying capacity of the jacket is cause for worry, horizontal slots may be provided also. Productionwise, they can be made in particularly simple manner.

It is known per se to give chimney jacket bricks a rectangular or square shape and to save cavities in the corner areas which are generally closed off at one face. Accordingly, the flow paths can be provided in the corner areas of a polygonal jacket. Inside diameters for flow paths are obtained also if there are large-scale shape differences so that additional profiling on a small scale in the sense of the previously discussed projections and depressions is no longer necessary. This obtains, for example, if a square inner tube is disposed in a round or oval heat insulation layer and the latter again in a rectangular or square jacket.

It is very expedient to provide vertically extending flow paths in order to utilize the thermal updraft of the venting gas for its transport. However, the verticality of the flow paths may have a component of inclination in the circumferential direction of the chimney to be able to cover greater areas for the removal of moisture in the same distance. This may involve, for instance, a spiraling flow path.

It is not necessary for the flow paths to be assigned to one certain casing or to one certain boundary area between two casings. The flow paths may also extend parallel in several casings and/or boundary areas between casings at the same time. The flow paths may even alternate between different casings along the chimney, be it between the heat insulation layer and the outer jacket or between the heat insulation layer and the inner tube, for instance, or even, for the supply of venting gas to the inner tube, through the jacket and through the heat insulation layer. In this connection, flow paths extending inside the inner tube may even be supplied in preferred manner with venting gas intermittently and in intervals at the periphery from the heat insulation layer filled with and/or washed by venting gas. Designwise, the inner tube inside the chimney may then be provided with venting gas inlet openings one above the other in certain intervals. But the alternation between different casings may also be utilized to provide in one casing certain vertical length sections of little flow resistance, using them to bridge zones of relatively high flow resistance in adjacent casings. For instance, free vertical transverse sections may be provided in the jacket, each being closed at the face of each molded part, thereby bridging the jacket sections either via the porosity of the heat insulating layer, or existing radial clearance areas, or peripheral profilings of the respective boundary layer. One advantage is the greater stability of the shell element not containing vertical through channels. In the case of the jacket, this makes it possible to obtain surfaces for the application of mortar without the risk of mortar falling into the venting channels. If the porosity of the heat insulating layer is utilized for the connection, the heat insulating layer may even be placed closely against the jacket in these connecting areas, thus forming a barrier against dropping mortar here, too, on the one hand, and utilize, on the other hand, at least in intervals, even those materials or microscopic forms of heat insulating layers whose flow resistance would otherwise be too great to be able to serve as venting gas flow path over the entire height of the chimney with sufficient effectiveness.

An adjusting device for the mass flow of the venting gas permits the setting of a new optimal compromise between maximum moisture removal and minimum chimney cooling whenever the operating conditions of the heating plant change. This adjusting device may be automatically controlled. The temperature or, alternatively, the moisture content of the discharging venting gas may be used as regulating variable, it also being possible to combine both measured quantities through a program to form one common regulating variable, if applicable.

The valve serving the mass flow adjustment may be designed as flap valve in particularly simple manner.

The thermal updraft is sometimes insufficient to transport the venting gas. A blower may then be used, to be mounted as required at the venting gas inlet and/or outlet. But one will usually strive to operate solely with thermal updraft.

Advantageously, a preheating system for the venting gas is employed. It not only increases the thermal updraft, but also the capacity of the venting gas to absorb moisture. Furthermore, it provides the possibility of avoiding undesirable cooling effects when venting gas is fed to the inner tube in particular. Conveniently, the smoke entering the chimney can be used for preheating through heat exchange, preferably by means of a heat exchanger interacting with the chimney connecting pipe for the exhaust gas.

In many cases, the flow paths will be conducted over the entire chimney height, if a great amount of moisture in the lower chimney zones must be reckoned with from the start. This applies in particular to modern boilers with low exhaust gas temperature. But the flow paths may also be conducted over a partial zone of the chimney only, especially over an upper chimney section only where the smoke cooling in the chimney becomes increasingly colder. This applies, for instance, when the chimney goes through a cold attic.

But it will be expedient in many cases to create different venting zones in sections over the height of the chimney, for instance to replace already moisture-laden venting air with fresh air.

The venting flow paths according to the invention can also be used when it is not intended to do away with vapor diffusion barriers. It can then be tolerated if such vapor diffusion barriers still have a certain permeability, and the venting flow rates can be reduced accordingly. Finally, the invention can even be utilized to upgrade chimneys equipped with vapor diffision barriers already aged or improperly installed, at any rate whenever the existing internal geometry of the chimney permits the connection of venting circuits. By the same token, the invention can also be utilized in the same way for the later upgrading of chimneys without vapor diffusion barriers.

Short-circuiting the flow paths in circumferential direction is not only advantageous for better distribution of the venting gas within the chimney, but also to be able to circumvent clogged sections which may have developed, preventing the passage of the venting gas. Moreover, greater freedom with regard to the angular alignment of the finished parts of which the chimney is constructed is obtained for the erection. In addition, the possibility is provided to have one connection, disposed in a single point of the circumference, suffice in the venting gas inlet and outlet areas whenever the internal configuration of the chimney prevents automatic distribution of the venting gas in the chimney. Nor is it a necessity then to coordinate the peripheral location of inlet and outlet relative to each other so that the connections at the foot of the chimney and in higher regions, perhaps at a chimney top, can be placed in different peripheral directions. If no short-circuits in circumferential direction are present, but the internal geometry of the chimney permits ultimate distribution of the venting gas over the entire cross-sectional area of the chimney, a diametral arrangement of inlet and outlet may even be utilized to force the flow path to go from one peripheral location to the other peripheral location, to particular advantage to the diagonally opposite peripheral location.

Hydrophobed materials, especially hydrophobed mineral fibers are known per se and commercially available. Heretofore, using them for chimneys did not make much sense because even the use of hydrophobed mineral fibers cannot prevent the insulating layer from being increasingly loaded with moisture and from drastically reducing its heat insulating action associated therewith. But within the scope of the invention, the application of hydrophobed materials is made useful to the utmost because clogging of pores or also excessive loading of pores of a heat insulation layer can be prevented with certainty, or at least whenever a certain moisture accumulation has taken place in the heat insulation layer, it can be reduced to tolerable limits or to zero again by venting in intervals.

It is in accordane therewith that venting according to the invention can basically be carried out in two ways. First, one can vent while the chimney is in operation, thus removing moisture continuously or in intervals. Secondly, however, one can also provide for venting during breaks in the operation of the chimney, thereby avoiding, or at least greatly reducing unnecessary chimney cooling or energy consumption in connection with preheating the venting gas. Depending on conditions and wishes, the adjustment device for the venting gas may be controlled automatically or manually.

The particularly simple attainment of flow paths as provided by the invention without additional costs. These measures are preferred in particular. Alternative embodiments and/or features thereof may have independent significance when less advantageously designed chimneys or finished chimney parts are involved, provided the flow-technical and control-technical advantages discussed are present. Thus, the control measures mentioned could also be provided for chimneys in which internal or external venting channels are obtained by additional structural measures.

BRIEF DESCRIPTION OF THE DRAWINGS

The invention is described below even more explicitly by way of several embodiments, with reference to schematic drawings, in which

FIGS. 6A and 6B each show a vertical half section of a respective alternative design for a chimney;

FIG. 7, in larger scale, a radial and vertical section of a finished jacket part with insulating layer and inner tube for a chimney according to the right half-picture of FIG. 6.

FIGS. 8B, 8C, 9A, 9B, 9C, 9D, 10A, 10B, 10C, and 10D each show a horizontal quarter section of a respective alternative chimney form; and FIGS. 11 and 12 each show a horizontal full section of an alternative chimney form.

DESCRIPTION OF EXEMPLARY EMBODIMENTS

The horizontal sections relate to both complete chimneys and finished chimney parts. Also, if chimneys are shown in whole or in part in vertical sections, these sections are likewise intended to describe the finished parts of which the chimneys are constructed. It is generally assumed that all chimneys shown are constructed of finished parts placed vertically on top of each other.

All chimneys or finished chimney parts shown and described are of three-casing construction comprising (at least) one smoke-carrying inner tube 2, a heat insulation layer 4 surrounding the inner tube, and a jacket 6 surrounding the latter in turn. In most cases, the base material of the inner tube is fire-clay, that of the heat insulating layer mineral fiber (including fiberglass), and that of the jacket lightweight concrete. All base materials suited for such three-casing chimneys can be used here also. Other designs commonly employed are likewise possible, such as additional air shafts and reinforcements in the jacket, furnace connections, etc. However, it is essential that all chimneys consist of the three casings mentioned only and that no materials other than the base materials of the three casings be required.

Figure 1:
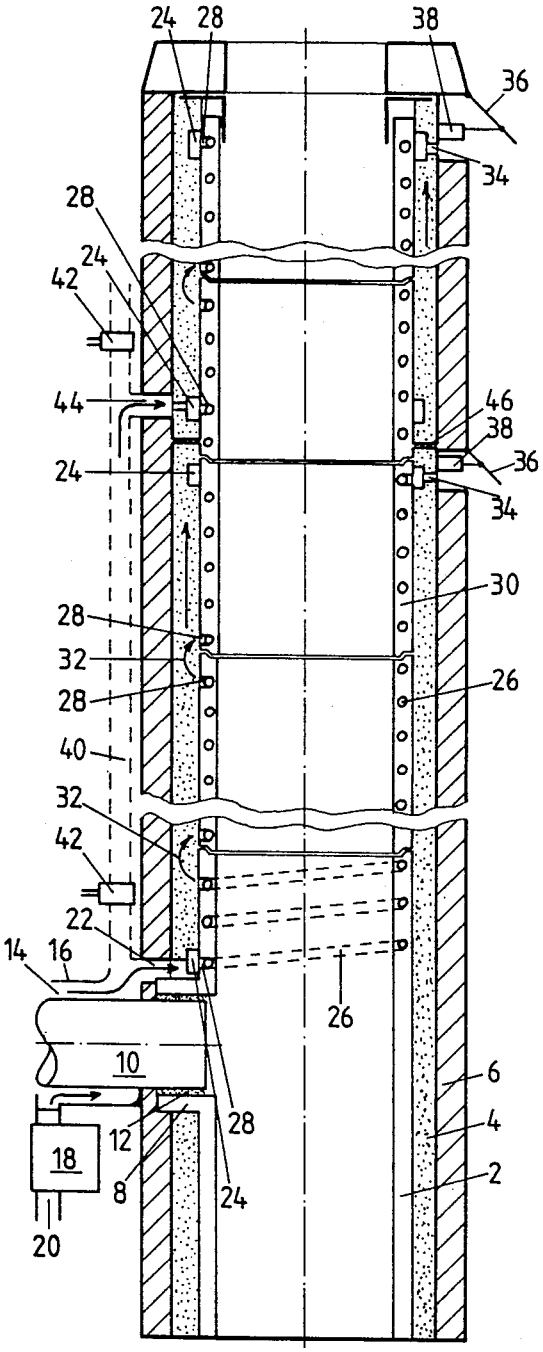
FIG. 1 shows a vertical and radial, partly broken off section of a first embodiment of a chimney.

In the chimney according to FIG. 1 a lateral nipple 8 is formed at the inner tube in the area of the chimney foot, to which nipple the connecting pipe 10 for the flue gas of the heating plant, not shown, is attached. The connecting pipe 10 penetrates the heat insulating layer 4 and the jacket 6 in cutouts formed in these two casings the nipple 8 also projecting partly into these cutouts.

The connecting pipe 10 is sealed all around against the nipple 8 by packing cord, cement or the like 12. The nipple 8 ends in the area of jacket 6.

The connecting pipe 10 is enclosed by an annular canal 14 of a heat exchanger 16, through which air from the chimney environment is attracted by a fan 18 at a suction port 20. This air is conducted through the annular canal 14 of the heat exchanger 16 according to the arrows and fed via a lateral canal 22 penetrating the jacket 6 into an annular canal 24 formed in the heat insulating layer 4 in the vicinity of the inner tube over part of the width of the heat insulating layer 4.

Internal channels 26, communicating with the annular canal 24 of the heat insulating layer through a lateral hole 28 in the inner tube, run helically upwards inside the inner tube 2. This opens up a first flow path from the annular canal 24 to the internal channels 26 in the inner tube 2 for the venting air aspirated at 20.

In addition, the heat insulating layer 4 is so porous that air can also rise next to the inner tube in the heat insulating layer 4 parallel to the inner tube 2.

Depending on the requirements, the design may be such that the flow path through the inner tube offers less flow resistance than the flow path through the heat insulating layer, or that the flow resistances are roughly the same, or that the conditions are reversed. It may happen that the flow resistance in the inner tube is very small compared to that of the heat insulating layer, but it may also happen that the flow resistance in the heat insulating layer is very small in relation to that in the inner tube. In the following, the case is considered in particular where the flow resistance in the inner tube is smaller than or very small in relation to that of the heat insulating layer.

The inner tube consists of individual tube sections 30, between each of which passage through the internal channels 26 is blocked by an intermediate layer. This intermediate layer may be joint mortar, but it may also be a packing material filled into the faces of the internal canals. In the area of both ends of each tube section is a lateral hole 28, like the hole which communicates with the annular canal 24. It is possible to recess in the area of these holes also an annular canal 24 in the heat insulating layer 4 each to provide the connection. In the embodiment example, however, the connection is made via a relatively short stretch each of the heat insulating layer 4, according to the connection arrows 32. Since the flow path then traverses a relatively short section of the heat insulating layer, the flow deceleration per unit of length is relatively small at the connecting sections despite the greater flow resistance. At the same time, however, a mixture of the venting air carried in the inner tube with the venting air rising in the heat insulating layer, and thereby, a diluting of air portions already more or less saturated with moisture, is obtained.

The situation regarding the other resistance ratios mentioned between flow path in the inner tube and flow path in the heat insulation layer is analogous.

Within one finished part, the inner tube may contain several tube sections 30.

It is possible that, in this manner, the flow path extends from the foot of the chimney to the chimney top. There again, an annular channel 24 is formed which communicates with the uppermost lateral hole 28 at the inner tube 2. This uppermost annular channel 24 collects the venting air which has flown through the chimney through the internal canals 26, on the one hand, through the heat insulation layer 4 on the other, conducting it to the outside via a lateral canal 34. As is evident, the lateral canal 34 is diametrically opposite the lateral canal 22 through which the venting air enters the chimney.

The venting air mass flow conducted through the chimney along the flow paths described can be adjusted by means of an adjustable venting flap 36 and regulated or varied as required by means of a servomotor 38 according to a regulating variable.

It is expedient to provide one special finished part which is assigned to the venting air inlet (and the connecting pipe 10) on the one hand, and to the venting air outlet on the other.

It is also possible, in a manner not shown, to provide the venting air inlet at a central chimney level, leaving the lower chimney region unvented.

However, FIG. 1 shows yet another alternative (in broken lines) in which the circuit through the chimney is divided into several vertically superposed part circuit. For this purpose there may be connected, for example, outside of the chimney or in the jacket, to the heat exchanger 16 a branch line 40, if applicable with mixing valve 42 admixing fresh air, which communicates only at a central chimney level, via a lateral canal 44, with an annular channel 24 in the heat insulating layer, conducting the venting air through this annular channel 24 into a lateral hole 28 and to the internal canals 26 connected thereto. A flow barrier 46 is provided in the heat insulating layer 4.

Provided below the flow barrier is another annular channel 24 in the heat insulating layer 4 which is led to the outside laterally through the chimney via a lateral channel 34. An air flap 36, adjustably by the servomotor 38, is provided here also. In this manner, a first flow circuit below the flow barrier 46 and another venting air flow circuit above the flow barrier 46 are obtained. Any desired multiplication is possible. For instance, if it takes two finished parts per floor of a residential building, one flow circuit may be provided for each floor, or per finished chimney part, or per any small number of finished chimney parts.

The venting air need not be preheated by the connecting pipe 10, as shown here. Separate preheating nipples may also be provided, or preheating may be omitted, particularly in upper chimney regions. The venting air may also be preheated by the connecting pipe 10 in the lowest circuit only, and separate preheating means may be provided in upper flow circuits.

Instead of relying on the porosity of the heat insulating layer 4 or in order to reduce the flow resistance at the available porosity further, a radial heat insulating layer 4 clearance or the cavities obtained thereby can be made use of also. According to FIGS. 2A and 2B, this radial clearance may be provided in the form of free space 48 between the heat insulating layer 4 and the inner tube 2 as shown in FIG. 2A, and/or in the form of free space 50 between the heat insulating layer 4 and the jacket 6 as shown in the FIG. 2B. Since the heat insulating layer happens to support itself more or less randomly partly against the inner tube 2 and partly against the jacket 6 if some radial clearance is specified, the free spaces 48 and 50 can be present only over part areas of the chimney length and/or of the chimney circumference. In any case, however, they can perform desired distribution function for the venting gas.

Figure 3:
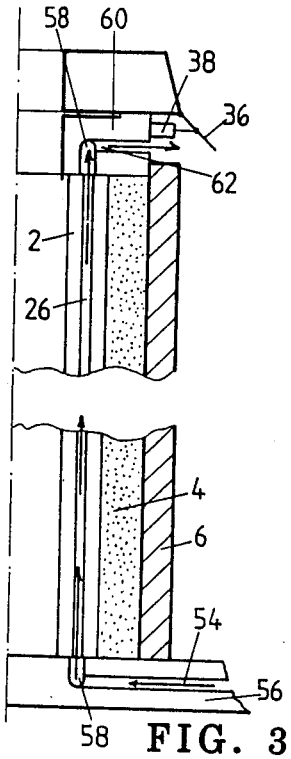
FIG. 3, in a broken off view, a vertical section and a section along aa radius of a chimney representing an alternative to FIG. 1.

Whereas the flow paths according to FIG. 1 run both within the inner tube 2 and in the heat insulating layer and the venting gas is supplied from the chimney periphery both to the heat insulating layer and to the inner tube, the venting gas flow path may also run in the inner tube only, with connections at the lower and the upper face of the inner tube. This is shown in FIG. 3. FIG. 3 (in conjunction with FIGS. 8A, 8B, 8C and 8D) also shows the alternative to FIG. 1, where a multiplicity of vertical internal canals 26 run in the inner tube 2 and are distributed over its circumference. The venting gas is supplied through a lateral channel 54 in a chimney base part. The venting air is distributed to the various internal canals 26 through an annular channel 58.

In corresponding manner, a distributor 60 which contains an annular channel 58 receiving the moisture-laden venting air and discharging it to the outside through a lateral channel 62 extends above the inner tube 2 and the heat insulating layer 4 in the chimney top. The configuration of air flap 36 and servomotor 38 corresponds to that of FIG. 1.

Figure 4:
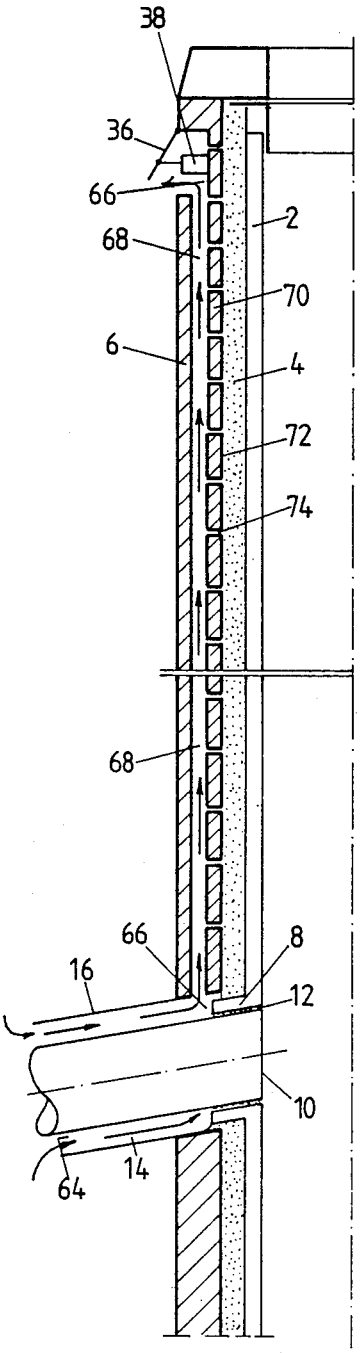
FIG. 4, in partly broken off representation, a vertical section and a section along a radius of another embodiment of a chimney.

FIG. 4 shows a chimney design alternative to FIG. 1, with the following special features:

The venting air inlet is designed with open, annular inlet section 64 so that the venting gas is transported solely by thermal updraft. Otherwise, the heat of the flue gas of the heating plant transported through the connecting pipe 10 is utilized to preheat the venting gas as in FIG. 1.

Designwise, the venting air outlet with air flap 36 adjustable by the servomotor 38 corresponds to the arrangement in FIG. 1, except that the outlet here is disposed on the same peripheral side as the inlet.

However, the features mentioned may also be exchanged with the corresponding arrangements of FIG. 1. The same applies to the possibility of providing several venting circuits over the height of the chimney or to restrict venting to one section only, particularly an upper chimney section.

The essential difference of the arrangement of FIG. 4 in comparison with that of FIG. 1 is that the flow path in FIG. 4 runs primarily through the jacket 6. For this purpose there is formed in the jacket, in the inlet and outlet areas, an annular channel 66 communicating with a number of venting canals 68 distributed over the circumference of the jacket 6 and rising vertically in it.

Figure 9B:
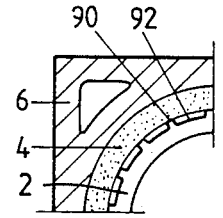

The venting canals 68 may allow diffusion radially inward due to the fact that the wall areas 70 of the jacket between the venting canals 68 and the inside jacket surface 72 facing the heat insulating layer 4 are designed so as to permit steam diffusion (see also FIG. 9B, upper right quadrant).

However, these wall areas 70 do not have to allow steam diffusion if breakthroughs 74 are provided in them which are distributed over the height of the vented chimney and connect the venting canals 68 to the area of the heat insulating layer 4.

Even if the inner tube 2 and the heat insulating layer 4 are not vented, as in the case of FIG. 1, venting the jacket can produce a radial flow gradient for the radially diffusing smoke laden with moisture and aggressive components and thus prevent the development of an undesired degree of moisture accumulation and precipitation of aggressive components in the radially inwardly located chimney area occupied by the venting canals 68 in the jacket 6. In this arrangement, the main venting air flow will flow within the jacket 6. But it may also come to a short-circuit flow in the heat insulating layer 4, due to it being coupled to the venting canals via the breakthroughs 74. It then depends on the relative flow resistance whether the main venting flow flows in the jacket 6 or in the heat insulating layer 4 (or alone or with the inclusion of peripheral gaps due to radial play of the jacket in the sense of FIGS. 2A and 2B).

It is also possible to combine the arrangement of FIG. 4 to this extent with that of FIG. 1 and to feed another flow flowing within the inner tube via a vertical flow in the heat insulating layer 4.

In jackets of rectangular, e.g. square, section, it is common practice to save mass by providing in the corner areas hollow spaces 76 (see FIGS. 9A, 9C and 9D) of rectangular section rounded at the corners which extend from the closed face of a finished part forming the jacket to the other open face and thus being easy to mold. This form of triangular hollow spaces 76 results from the casing located radially further inward, i.e. the heat insulating layer 4, being of round section on the outside.

The profile of these hollow spaces can be taken over completely for the venting canals 68. The breakthroughs 74 may assume different shapes.

FIG. 7 shows one preferred shape of the breakthroughs 74. According thereto, the breakthroughs 74 are horizontal slots at the lower and at the upper end of moldings which form the jacket 2 and in which the wall areas 70 are recessed relative to the entire length of the moldings in the area of the horizontal slots 74. The construction shown in the right view of FIG. 6A is thus obtained where the respective moldings 78 forming the jacket are tightly joined on the outside by a mortar layer 80 in the area of the level of the breakthrough 74 common to two adjacent moldings.

In this connection it is expedient to design the finished chimney parts so that the step joint 84, sealed by refractory mortar 82, between abutting inner tubes 2 is staggered axially up to half a molding length relative to the mortar layer 80 or the joint between the moldings 78 of the jacket.

Figure 5C:
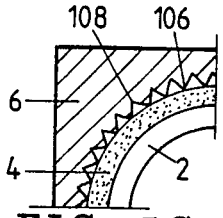
FIGS. 5A, 5B, 5C and 5D each show a horizontal quarter section of a respective alternative embodiment of a chimney, the embodiments of FIGS. 5A and 5B may have vertical sections in accordance with FIGS. 6A and 6B.
Figure 5D:
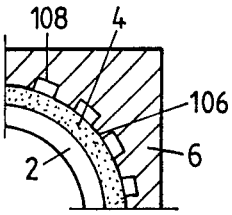
Figure 5B:
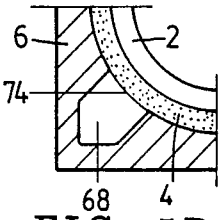
Figure 5A:
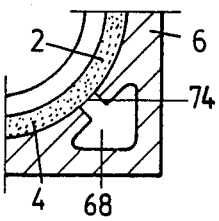

As an alternative to the horizontal slots described, the breakthroughs 74 may also be formed by vertical slots, as shown in the two lower quadrant views of FIGS. 5A and 5B. There, the vertical slots 74 are of narrow design in the lower right quadrant view of FIG. 5A relative to the flow path diameter in the venting canal 68 as measured in circumferential direction of the chimney, while extending essentially over the entire flow path diameter as measured in circumferential direction of the chimney in the lower left quadrant of FIG. 5B. Accordingly, the profile in the lower right quadrant is mushroom-shaped and house-shaped in the lower left quadrant.

The lower right quadrant view of FIG. 5A illustrates that, in modification of the arrangement shown in FIG. 4, the breakthroughs 74 are united to form one common vertical slot extending alongside the entire associated venting canal 68. However, vertical slots of analog profile need extend only over a limited height.

According to the left half view of FIG. 6A, one may also design the breakthroughs 74 (in the two alternatives shown in FIGS. 5A and 5B) so as to go through from the lower face of the molding 78 forming the jacket almost to its upper face and interrupt the respective venting canal 68 as well as the associated breakthrough 74 by a wall 86 on the face of the molding 78 in the upper face area of the respective molding 78 so that, in the area of the face walls 86, each venting path is deflected into the adjacent area of the heat insulating layer 4 or of a radial clearance 50 in the sense of the left view of FIG. 2A present there. Therefore, the flow path here runs in the various moldings 78 inside the jacket 6 and outside thereof with short-circuit bridging in the area where the heat insulating layer 4 is installed, or in the latter's porosity itself. Since, again, short axial stretch of the heat insulating layer 4 only are required to deflect the flow path out of the jacket 6, the flow resistance of the heat insulating layer itself may still be relatively high without impairment of the function.

The wall 86 here serves as carrier of the mortar layer 80 which, differing from the view shown in the right half of FIG. 6B, may here extend over the entire face of the jacket 6.

So far, only a few of the many possibilities have been described how venting gas flow paths can be conducted through the chimney. In all cases, the inlet for the venting air or another venting gas and the associated outlet may be disposed as illustrated in FIGS. 1 and 4 or possibly also in FIG. 3 in appropriate modification. It is always essential that the inlet canal and the outlet canal for the venting gas end in the respective cavities in which the venting gas flow path runs through the actual body of the chimney. In this context it is imaginable to vent horizontally by zones only. But one will generally use flow paths rising in the chimney either in directly vertical arrangement or at least having a vertical component, like the helical path of the canals 26 in FIG. 1. Without restriction of the generality, a vertically rising flow path is referred to in the following which, however, may also contain a horizontal component.

It is also always assumed that a separate, fitting, finished chimney part is coordinated with each venting gas inlet and outlet. Between them, partly known and partly specially adapted chimney profiles of the finished chimney parts located in between may be used. Hereinafter, such typical chimney profiles are described in detail, which may be used singly or also in any combination.

A comparison of the horizontal sectional views of FIGS. 10A, 10B, 10C and 10D with those of FIGS. 2A, 2B, 5A, 5B, 5C, 5D, 8A, 8B, 8C, 9A, 9B, 9C and 9D shows further that inner tubes 2 of rectangular, here of square, shape slightly rounded at the corners (FIGS. 10A, 10B, 10C and 10D) as well as inner tubes of cylindrical shape (the other Figures mentioned) may be used. If one or the other flow path design is described below for one of these inner tube profiles, it is analogously transferrable to the other profile also.

In the preferred embodiment examples, if the inner tube 2 is cylindrical, the heat insulating layer 4 is cylindrical also, while the jacket 6 is rectangular or square. If the inner tube 2 is square (or rectangular), the adjacent casings of the heat insulating layer 4 and of the jacket 6 are square or rectangular also. In both cases, the heat insulating layer 4 may be composed of insulating panels which, in the case of the curved shape of the heat insulating layer, may themselves be curved. If no special functions are assigned to the hollow spaces in the jacket 6, as described for the venting canals 68, the horizontal profiles in the following, regardless of the form of representation selected, refer to embodiments in which the profile of the jacket 6 is solid according to FIGS. 8A, 8B and 8C, as well as to embodiments in which, according to FIGS. 9A, 9B, 9C and 9D, there are cavities 76 in the corner areas. Such cavities come into question especially when the heat insulating layer is cylindrical, the corresponding inside wall of the jacket 6 is likewise cylindrical, but the outside wall of the jacket 6 is rectangular. However, even if jackets are rectangular inside and out, additional cavities not shown may still be present. In both specially mentioned configurations additional shafts such as air shafts may be present.

Figure 8C:
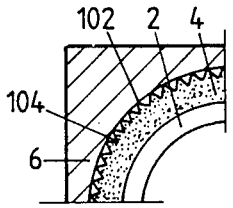
Figure 8B:
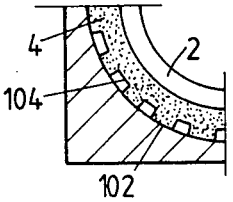
Figure 8A:
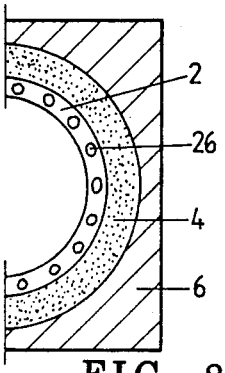
FIG. 8A, shows a horizontal half section of an alternative chimney form.

The right half view of FIG. 8A shows once more the arrangement of FIG. 3 in horizontal transverse section. Here, the internal channels 26 run vertically in the inner tube 2, and internal holes in the wall of the inner tube 2 are evenly distributed over its circumference.

Figure 9A:
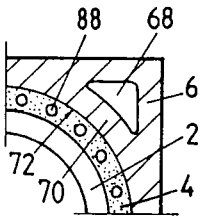

According to the upper right quadrant view of FIG. 9A, corresponding internal venting channels 88 may also be provided in the heat insulating layer 4, within whose wall they extend vertically and over whose circumference they are evenly distributed. Both upper quadrant views of FIGS. 10A and 10B show that the internal channels 88 may, as shown in FIG. 9A, be either of round or differently shaped section; here, according to the upper right quadrant view of FIG. 10A, an elongated slot shape extending in the circumferential direction of the casing forming the heat insulating layer. Corresponding design freedom as to the section of the internal channels is, of course, also available in the other comparable cases, such as in the case of the internal channels 26 of the inner tube 2.

The upper right quadrant view of FIG. 9A shows further that the cavities 76 in the outer jacket (according to the other quadrants) may also be replaced by a through canal 68 of the same cross-section which is coupled to the area lying radially inward by a likewise through wall 70 which, however, allows steam diffusion.

The profile of the venting channels 68 of the jacket 6 may also be varied provided; this does not weaken the wall stability too much statically.

Figure 2B:
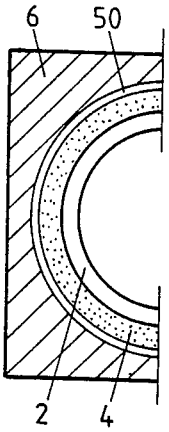
FIGS. 2A and 2B each show a horizontal half section of a respective modified embodiment of the chimney according to FIG. 1.
Figure 2A:
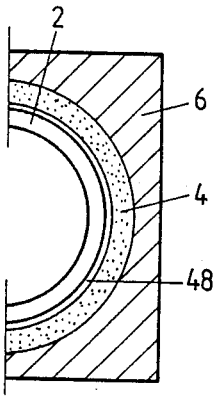

But flow paths serving ventilation may also extend in boundary layers between two adjacent casings, as already described by way of FIGS. 2A and 2B for the example of a radial clearance 50 between the jacket 6 and the heat insulating layer 4 or 48 between the heat insulating layer 4 and the inner tube 2. If there is no free space due to radial clearance or if its free cross-section area is insufficient, flow path profiles may be formed at the respective boundary layers of the casings. Profiling one of the barrier layers on one of the casings will usually suffice; but a complementary flow path design by profiling both mutually facing boundary layers of the casings is also possible.

Preferred is a profile in which the respective boundary layer is alternatingly provided with projections and depressions in the circumferential direction of the associated casing so that the flow paths run between the projections in the depressions.

In the upper left quadrant view in FIG. 9B, such projections 90 are designed as webs which leave between them a relatively large circumferential sector so that the depressions 92 formed thereby are curved slots along the circumference of the inner tube 2. The heat insulating layer 4 is supported radially inwardly by the webs 90.

Figure 9C:
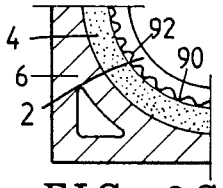

If this support is inadequate, or if slots running in circumferential direction near the inner tube are not desired, a corrugation, possibly a narrow one, according to the lower left quadrant view of FIG. 9C, may also be provided, its valleys forming the depressions 92 and its peaks the projections 90, a multiplicity of projections 90 supporting the heat insulation layer 4 radially inwardly.

Figure 9D:
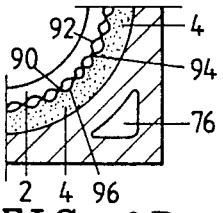

Without restricting generality by the example of a corrugation, the lower right quadrant view of FIG. 9D shows that the inside of the heat insulating layer 4 facing the inner tube 2 may also be provided with a corrugation of projections 94 and depressions 96 complementing the projections 90 and depressions 92 at the circumference of the inner tube 2 so that the flow paths run vertically along the boundary layer between the inner tube 2 and the heat insulating layer 4 in the complementary depressions 92 and 96. This does not require a flow short-circuit in circumferential direction, which is also possible, however.

It goes without saying that the corrugations may be of any known shape, be it with curved or straight lines, be it sawtooth-shaped or with alternating grooves or fins with radial or inclined groove walls. Preferred are profiles which are particularly well-suited as spacers for the heat insulating layer, yet leave free between them a favorable venting profile.

The lower left quadrant view in FIG. 10C shows that corresponding projections 98 and depressions 100 are formed also at the boundary surface of the heat insulating layer 4 facing the inner tube 2; here, without limiting generality, by the example of alternating rectangular webs and grooves. In contrast to what the upper left quadrant view of FIG. 9C shows, the distance between the grooves may be about the same or only slightly greater than the groove width, in order to get the optimal cross-sectional area between heat insulating layer support and venting gas flow path profile. But embodiments are also imaginable in which the projections 98 are narrower than the width of the depressions 100 (to this extent as shown in the upper left quadrant view of FIG. 9B), but the depressions also having only a relatively small circumferential extent.

Corresponding projections 102 and depressions 104 may also be provided at the outside of the heat insulating layer 4 facing the jacket, as shown—again without limiting generality—by way of a rounded sawtooth form in the upper left quadrant and by way of a trapezoidal sequence of grooves and webs in the lower left quadrant view of FIG. 8B.

The projections 102 and depressions 104 may also be formed by the webs and slots of an expanded, slotted and bent heat insulating panel according to FIG. 2 of DE-AS No. 21 18 046. By reversing the orientation of the slotted heat insulating panel, a corresponding design is also possible for the projections 98 and depressions 100.

Finally, the inside of the jacket 6 facing the heat insulating layer 4 may also be designed with projections 106 and depressions 108, again extending as corrugation over the circumference of the jacket.

Without limiting generality, the peripheral corrugation in the upper left quadrant view of FIG. 5C is of such zigzag shape that the angles of the projections and depressions are each almost rectangular, whereas the zigzag corrugation in the upper left quadrant view of FIG. 8C shows acute angles and depressions.

In the upper right quadrant view of FIG. 5D, the peripheral corrugation consists of alternating rectangular grooves and webs, the webs width being slightly less than the groove width. This shape, too, is exchangeable against the trapezoidal shape of the lower left quadrant view of FIG. 8B of the corresponding corrugation at the heat insulating layer.

In this boundary layer area also, grooves and depressions on the heat insulating layer may oppose grooves and depressions on the jacket completely or partly in complementary fashion.

In the embodiments described so far, both mutually opposite boundary surfaces of adjacent casings were either round or rectangular as a whole, and the profiling in circumferential direction merely represented a detail design of this large basic shape.

But FIGS. 11 and 12 shows that the large basic shape at the mutually facing boundary layers of adjacent casings may be different also, in order to obtain venting gas flow paths in the space thus gained.

FIG. 11 illustrates the case where the inner tube 2 and the heat insulating layer 4 are cylindrical while the jacket 6, here of constant wall thickness, is square. This causes the heat insulating layer 4 to be retained and centered at four external bearing points 110 in the jacket 6, a certain radial clearance being possible in addition. Roughly triangular sections 112 are obtained in the four corners between the heat insulating layer 4 and the jacket 6.

While the venting gas flow path here runs along the border between heat insulating layer 4 and jacket 6, it runs between the inner tube 2 and the heat insulating layer 4 in the embodiment according to FIG. 12. Here, the inner tube 2 and the jacket 6 have the same shape as in FIG. 11. But the heat insulating layer is composed of four straight insulating panels 4, of which one opposite pair each extends along the entire length of two opposite inside surfaces of the jacket 6, while the two other insulating panels cover the other two inside surfaces of jacket 6 between the first pair of insulating panels. Here, the inner tube 2 is centered by four bearing points 114 in the heat insulating layer 4 and, if applicable, retained with some radial play, and a section 116 for a venting gas flow path each is gained in the corners between the inner tube 2 and the heat insulating layer 4. There are four such sections in the embodiments of both FIG. 11 and FIG. 12, which sections, if applicable, may yet be shaped, e.g. constricted, in their cross-sectional area as desired. Four bearng points, distributed over the circumference by 90° each, are sufficient to center the heat insulating layer (FIG. 11) or the inner tube (FIG. 12).

It goes without saying that in addition to the described round and rectangular or square configurations of individual casings other casing forms, such as elongated, oval or elliptical ones, may be used also, as well as all other forms by which boundary layers of adjacent casings differ as a whole while forming a free cross-section for a venting gas.

I claim:

1. Multiple-casing chimney with at least one smoke-carrying inner tube, a heat insulating layer surrounding the inner tube, and a jacket supporting the outside of the heat insulating layer, characterized in that canal means defining flow paths, distributed over the circumference of the chimney, are provided within the jacket for a venting gas supplied from and discharged to the outside, the flow paths including means for communicating with the heat insulating layer, the shape of the inner circumference of the jacket differing from that of the other circumference of the jacket so as to define sections of the jacket, spaced about the circumference of the jacket, that have an increased wall thickness, the flow paths being provided at least in part in the thicker sections of the jacket.

2. Chimney according to claim 1, characterized in that the inner surface of the jacket facing the heat insulating layer is alternately provided with projections and depressions (108) in circumferential direction and flow paths run between the projections in the depressions.

3. Chimney according to claim 1, characterized in that the jacket wall includes means for allowing vapor diffusion, the vapor diffusion means being formed between the flow path and the inner jacket surface facing the heat insulating layer.

4. Chimney according to claim 1, characterized in that the flow paths extend within the jacket from the bottom to the top and are open towards the inside surface of the jacket facing the heat insulating layer via breakthroughs in the jacket.

5. Chimney according to claim 4, characterized in that the breakthroughs are vertical slots.

6. Chimney according to claim 5, characterized in that the vertical slots and the flow paths have substantially equal diameters as measured in the circumferential direction of the chimney.

7. Chimney according to claim 5, characterized in that the vertical slots have narrower diameters than the diameters of the flow paths, the diameters being measured in the circumferential direction of the chimney.

8. Chimney according to claim 5, characterized in that the vertical slots comprise at least a portion of the flow paths.

9. Chimney according to claim 3, characterized in that the jacket has a polygonal shape and the flow paths are formed in corner areas of the jacket.

10. Chimney according to claim 1, characterized in that an adjusting device is arranged along at least one flow path for regulating the venting gas mass flow.

11. Chimney according to claim 10, further comprising automatic control means for controlling the adjusting device as a function of the temperature of the discharging venting gas.

12. Chimney according to claim 10 or 11, characterized in that the adjusting device includes a flap valve.

13. Chimney according to claim 1 wherein the flow paths transport the venting gas by thermal updraft.

14. Chimney according to claim 1, further comprising a venting gas preheating device for heating the venting gas prior to supplying the venting gas to the flow paths.

15. Chimney according to claim 1, characterized in that the flow paths extend essentially over the entire height of the chimney.

16. Chimney according to claim 10, further comprising automatic control means for controlling the adjusting device as a function of the moisture content of the discharging venting gas.

17. Chimney according to claim 10, further comprising automatic control means for controlling the adjusting device as a function of the temperature and moisture content of the discharging venting gas.

18. Chimney according to claim 14, wherein the venting gas preheating device includes a heat exchanger interacting with an exhaust connecting pipe of the chimney.

* * * * *